US007997248B2

(12) United States Patent
Rexavier et al.

(10) Patent No.: US 7,997,248 B2
(45) Date of Patent: Aug. 16, 2011

(54) CORROSION RESISTANT VALVE GUIDE

(75) Inventors: Raji Rexavier, Clarendon Hills, IL (US); Robert T. MacVicar, Downers Grove, IL (US); Edward J. Cryer, III, Homer Glen, IL (US)

(73) Assignee: Electro-Motive Diesel Inc., LaGrange, IL (US)

( * ) Notice: Subject to any disclaimer, the term of this patent is extended or adjusted under 35 U.S.C. 154(b) by 391 days.

(21) Appl. No.: 12/204,146

(22) Filed: Sep. 4, 2008

(65) Prior Publication Data

US 2010/0050973 A1 Mar. 4, 2010

(51) Int. Cl.
*F02N 3/00* (2006.01)

(52) U.S. Cl. ..... 123/188.9

(58) Field of Classification Search ..... 123/188.9
See application file for complete search history.

(56) References Cited

U.S. PATENT DOCUMENTS 2,162,304 A 6/1939 Gross
2,175,261 A 10/1939 Harbaugh
3,127,880 A * 4/1964 Meurer et al. ..... 123/188.9

FOREIGN PATENT DOCUMENTS

DE 3615018 C1 * 5/1987
DE 288431 A * 3/1991

* cited by examiner

*Primary Examiner* — Noah Kamen
(74) *Attorney, Agent, or Firm* — Eugene Cummings

(57) ABSTRACT

The present invention generally relates to a new valve guide for use in an exhaust valve system. Specifically, the invention is related to a valve guide that prevents acidic corrosion between the valve and the valve guide. The valve guide includes a number of contact portions, which engage the channel that is formed in the cylinder head near the exhaust port. The valve guide also includes a recess portion, situated in relation to a water jacket and between the contact portions. The recess portion and contact portions are sized and shaped to maintain the surface temperature of the valve guide to prevent condensation of acidic gases between the valve stem and the valve guide.

11 Claims, 10 Drawing Sheets

CORROSION RESISTANT VALVE GUIDE

BACKGROUND OF THE INVENTION

The present invention generally relates to a new valve guide for use in an exhaust valve system. Specifically, the invention is directed to a valve guide that maintains the temperature of its surface in order to prevent condensation of acidic gases, and thereby corrosion, of the valve and the valve guide. Additionally, the present invention is directed towards a method of maintaining the surface temperature of the valve guide in order to prevent corrosion.

It is known in the art relating to internal combustion engines, such as diesel engines (e.g., locomotive diesel engines), to actuate two adjacent valves of an engine cylinder by a rotating cam. For example, in FIG. 1, the cam 154 includes a select shape which determines the timing of valve 104 actuation. In order to open the valves 104, the cam 154 rotates until a cam lobe 156 engages a roller 158 located on a rocker arm 152. Once the cam lobe 156 engages the rocker arm 152, the rocker arm 152 in turn engages a valve bridge 160, which causes compression in adjacent springs 150*a*, 150*b* that cause the valves 104 to open. A valve guide 100 is used to position the valve 104 within the cylinder head 106.

In general, valve guides and valves are subject to extremely high thermal and mechanical stress. Due to the duty cycle imposed on engines and the possible use of different grades of diesel, the valve guide is subjected to increased levels of acid which condenses thereon, resulting in corrosion and premature failure of the valve guide. More specifically, exhaust gases enter the clearance between the valve and the valve guide during engine operation. The water jacket, which is used to cool the valve and the cylinder head, also cools the exhaust gases causing them to condense. As a result, acid forms between the valve guide and the valve, resulting in corrosion of both the valve and the valve guide.

Diesel engines operating on high sulfur fuels periodically require grinding of the exhaust valves and seats employed therein due to corrosion effects and exposure to high heat levels and the acid formed thereon. Such corrosion tends to induce a channeling or guttering of the valve faces which accelerates such corrosion and gives rise to gas leakage past the valves and potential breakage of the valve heads.

Additionally, valve guides in traditional valve train systems are subject to corrosion due to the acid formed thereon. Previously, a relatively soft metal was used for valve guides in engines. As a result, such valve guides were readily worn and corroded during operation of the engine. Additionally, the acid creates a clearance between a shaft hole of the valve guide and a valve stem which causes an oil-containing gas and smoke to be discharged. As a result, various measures have been taken to prevent the valve guide from being worn and corroded. For example, corrosion resistant Ni-Resist material has been used to prevent valve guide failure. However, due to the increased cost of Nickel, a dominant constituent in the Ni-Resist alloy, the part cost has increased significantly.

Therefore, it is an aspect of the present invention to provide a method for maintaining the surface temperature of the valve guide in order to prevent condensation of acidic gases into acid (e.g., sulfuric acid ($H_2SO_4$)) between the valve and the valve guide. This method may include the extension of the valve guide into the exhaust port of the valve train system to increase the surface temperature of the valve guide. Additionally, it is another aspect of the present invention to provide a valve guide including a recess portion to loosen the engagement between the cylinder head wall and the valve guide. This recess portion maintains the surface temperature of the valve guide to prevent condensation of sulfuric acid.

Although a recess portion had been used in prior art, it was used only to fit the valve into the cylinder. The prior art recess portions were not sized and shaped to maintain the surface temperature of the valve. In contrast, the present invention uses a recess portion to control the surface temperature of the valve guide to prevent exhaust gases from condensing to form acid thereon.

SUMMARY OF THE INVENTION

The present invention generally relates to a new valve guide for use in an exhaust valve system. Specifically, the invention is related to a valve guide that prevents acidic corrosion between the valve and the valve guide. The valve guide includes a number of contact portions, which engage the channel that is formed in the cylinder head near the exhaust port. The valve guide also includes a recess portion, situated in relation to a water jacket and between the contact portions. The recess portion and contact portions are sized and shaped to maintain the surface temperature of the valve guide to prevent condensation of $H_2SO_4$ between the valve stem and the valve guide.

Additionally, the present invention is directed towards a method for maintaining the surface temperature of the valve guide to prevent acidic corrosion that includes the step of extending the valve guide into an exhaust port to increase the surface temperature of the valve guide. Further provided is a method for sizing and shaping the recess portion relative to the water jacket to control the surface engagement between the valve guide and the cylinder head so as to maintain surface temperature to prevent condensation of acidic gases. This method also includes the step of sizing a clearance in the valve guide near the exhaust port to allow exhaust gases to surround a portion of the valve guide to further control surface temperature of the valve guide.

DETAILED DESCRIPTION OF THE DRAWINGS

Figure 1:
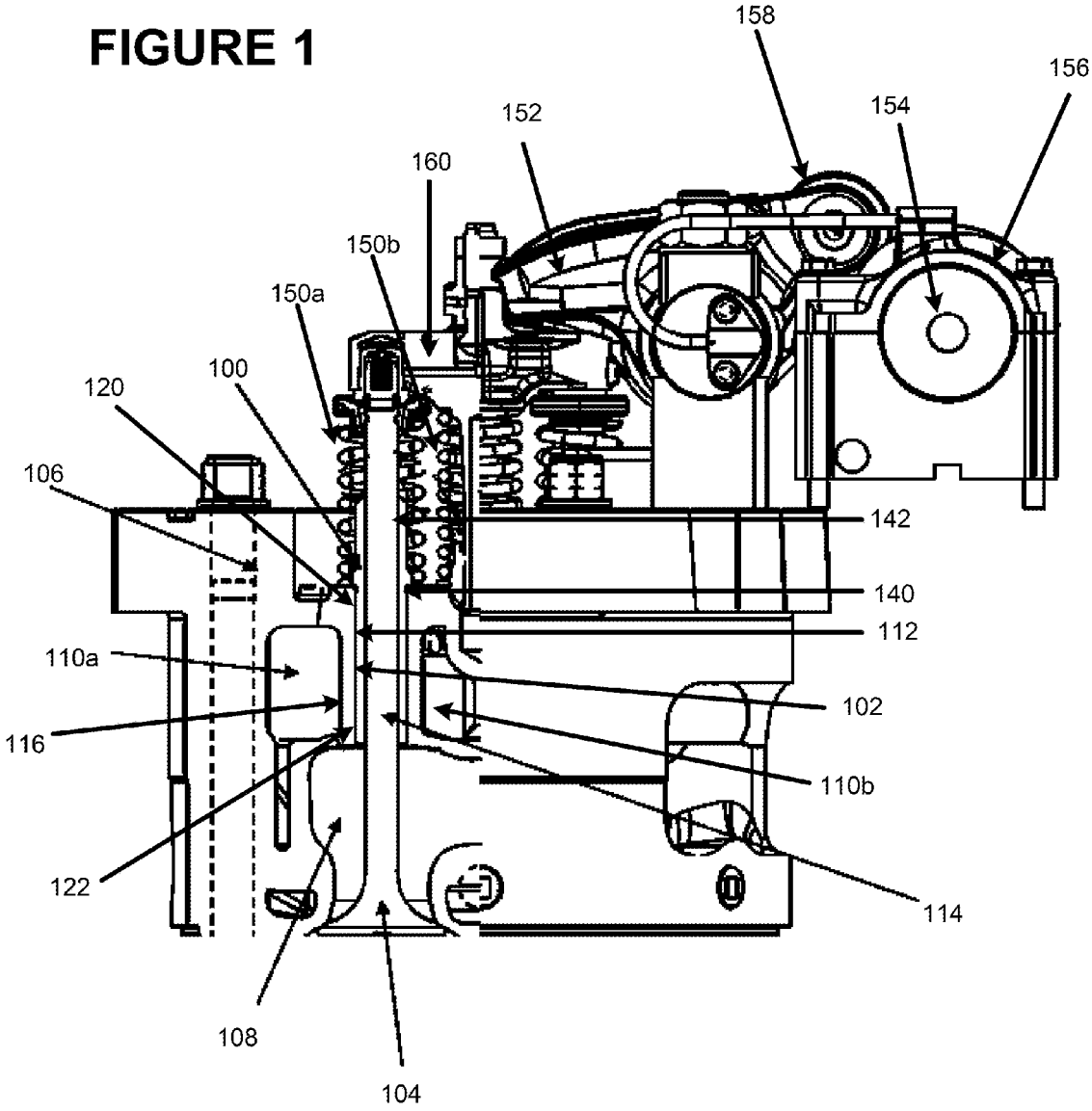
FIG. 1 is a cross-sectional view of a first embodiment of a valve train system, which the present invention is a part, showing a valve guide including a recess portion for maintaining its surface temperature.

FIG. 1 illustrates a valve train system, which the present invention is a part. The valve guide 100, in accordance with an aspect of the present invention, is situated in a channel 102 formed between the valve 104 and the cylinder head 106. The valve guide 100 guides the valve stem 114 through the channel 102, which further joins the upper portion of the cylinder head 106 via a shoulder 140 to an exhaust port 108. The cylinder head 106 includes a water jacket 110, which is disposed near the channel 102. The water jacket 110 is intended to cool the valve 104 to prevent over-heating thereof. However, exhaust gases enter the clearance between the valve 104 and the valve guide 100 during engine operation. Accordingly, the water jacket 110 may inadvertently cause gases to condense between the valve 104 and the valve guide 100, thereby causing corrosion. An estimate of the sulfuric acid ($H_2SO_4$) in the exhaust stream is shown in Table 1.

TABLE 1

| | |
|---|---|
| Fuel rate | 1455 lb/hr |
| Mole fraction of $H_2SO_4$ | $3.059\left(\frac{H_2SO_4}{S}\right)$ |
| Mole fraction of $H_2O$ | $17.87\left(\frac{H_2O}{H}\right)$ |
| Sulfur content in diesel | 3% (by weight) (approx.) |
| H content in diesel | 15% (by weight) (approx.) |
| $H_2SO_4$ formed | (100% conversion) 1455 * .3% * 3.059 * 453.59 = 6056.7 g/hr |
| $H_2O$ formed (100%) conversion) | 1455 * 15% * 17.87 * 453.59 = 1769058.8 g/hr |
| Concentration of $H_2SO_4$ | |
| @ 30% $H_2O$ conversion 1.14% by weight | |
| @ 10% $H_2O$ conversion 3.42% by weight | |

Accounting for the calculated $H_2SO_4$ concentration, operating pressure and a safety factor of 3, it is estimated that if the valve guide runs above about 229° F. at a depth of about 2.25 inches (which corresponds to the depth at which maximum corrosion is seen) from the top of the valve guide, condensation of $H_2SO_4$ may be prevented and thereby acidic corrosion. In order to overcome this problem, it is an aspect of the present invention, shown in FIG. 1, to control the transfer of cool temperatures from the water jacket 110 to the valve guide 100. The surface temperature along the length of the valve guide 100 is maintained above the critical surface temperature of about 229° F. to avoid condensation, and thereby acidic corrosion. Although temperatures may vary from the bottom portion to the top portion 142 of the valve guide 100, the entire length is to be maintained above the temperature at which the exhaust gases condense, i.e. above about 229° F. The bottom portion of the valve guide 100 is the hottest portion because it is situated next to the exhaust port 108, and may be a maximum temperature of about 600° F.

In order to maintain the critical surface temperature of about 229° F., the present invention valve guide generally includes a recess portion and contact portions. The recess portion lessens the transfer of cooling temperatures from the water jacket to the valve guide. Thus, the larger the recess portion is, the higher the surface temperature will be for the valve guide. Additionally, in order to further control the surface temperature of the valve guide, the recess portion is further sized and shaped relative to the water jacket.

Moreover, the present invention also generally provides a number of different contact points that engage the cylinder head wall in order to maintain the surface temperature of the valve guide. More specifically, the looser the engagement is between the cylinder head wall and the valve guide, the less cooling temperatures are able to transfer from the water jacket to the valve guide. The tighter the engagement is between the cylinder head wall and the valve guide, the more cooling temperatures are able to transfer from the water jacket to valve guide. In yet another embodiment, the radial thickness of the cylinder head wall between the water jacket and the channel or the radial thickness of the valve guide itself may further be adapted to maintain the critical temperature. Additionally, the composition of the cylinder head or the valve guide itself may be adapted to further maintain surface temperature.

Figure 2:
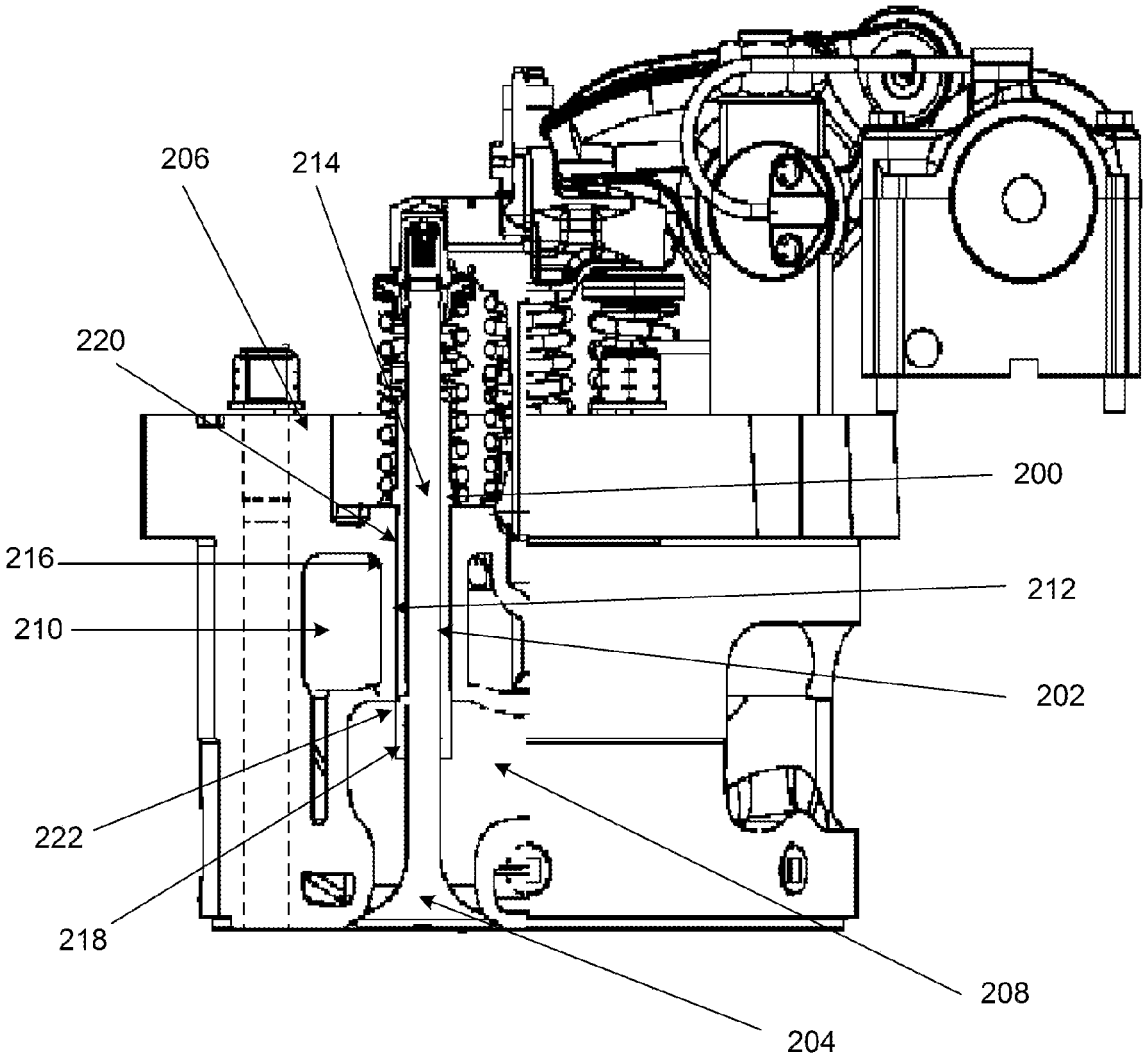
FIG. 2 is a cross-sectional view of a second embodiment of a valve train system, which the present invention is a part, showing a valve guide which extends into an exhaust port for maintaining its surface temperature.

In another embodiment of the present invention, shown in FIG. 2, a valve guide 200 is provided which includes an extension 218 into the exhaust port 208 for maintaining the surface temperature. The extended portion 218 of the valve guide 200 reaches into the exhaust port 208, for heating thereof. The temperature in the exhaust port 208 may be between about 600° F., when the engine is at an idle position, and about 1000° F., when the engine is in full-throttle. The more extension the valve guide 200 has into the exhaust port 208, the hotter the valve guide 200 will become. The extended portion 218 is further sized and shaped to maintain and facilitate the maintenance of the surface temperature of the valve guide 200 above the critical temperature of about 229° F.

Additionally, the extension 218 may be coupled with contact portions 220, 222 and a recess portion 212. The recess portion 212 lessens the transfer of cooling temperatures from the water jacket 210 to the valve guide 200. Thus, the larger the recess portion 212 is, the higher the surface temperature of the valve guide 200 will be. Additionally, in order to further control the surface temperature of the valve guide 200, the recess portion 212 is further sized and shaped relative to the water jacket 210.

Moreover, the second embodiment may further include contact portions 220, 222 that engage the cylinder head wall 216. A looser engagement between the cylinder head wall 216 and the valve guide 200 inhibits the transfer of cooling temperatures from the water jacket 210 to the valve guide 200, thereby preventing exhaust gases from condensing. The radial thickness of the cylinder head wall 216 between the water jacket 210 and the channel 202 or the radial thickness of the valve guide 200 itself may further be adapted to maintain the surface temperature of the valve guide 200. Additionally, the composition of the cylinder head 206 or the valve guide 200 may be adapted to further maintain surface temperature.

Example 1

Figure 3A:
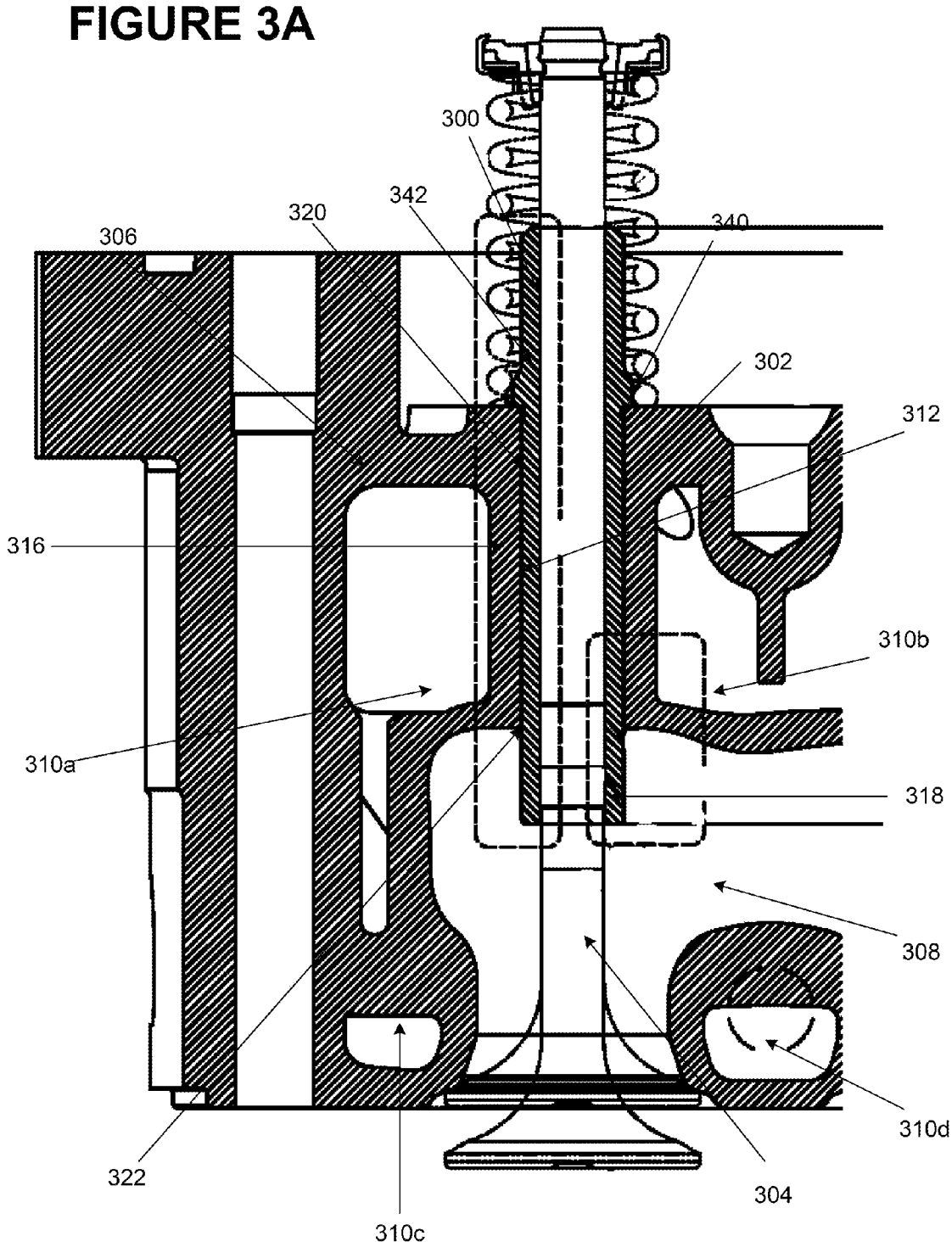
FIG. 3A is a detailed cross-sectional view of a third embodiment of the valve train system, showing a valve guide including a recess and which extends into an exhaust port for maintaining its surface temperature.
Figure 3B:
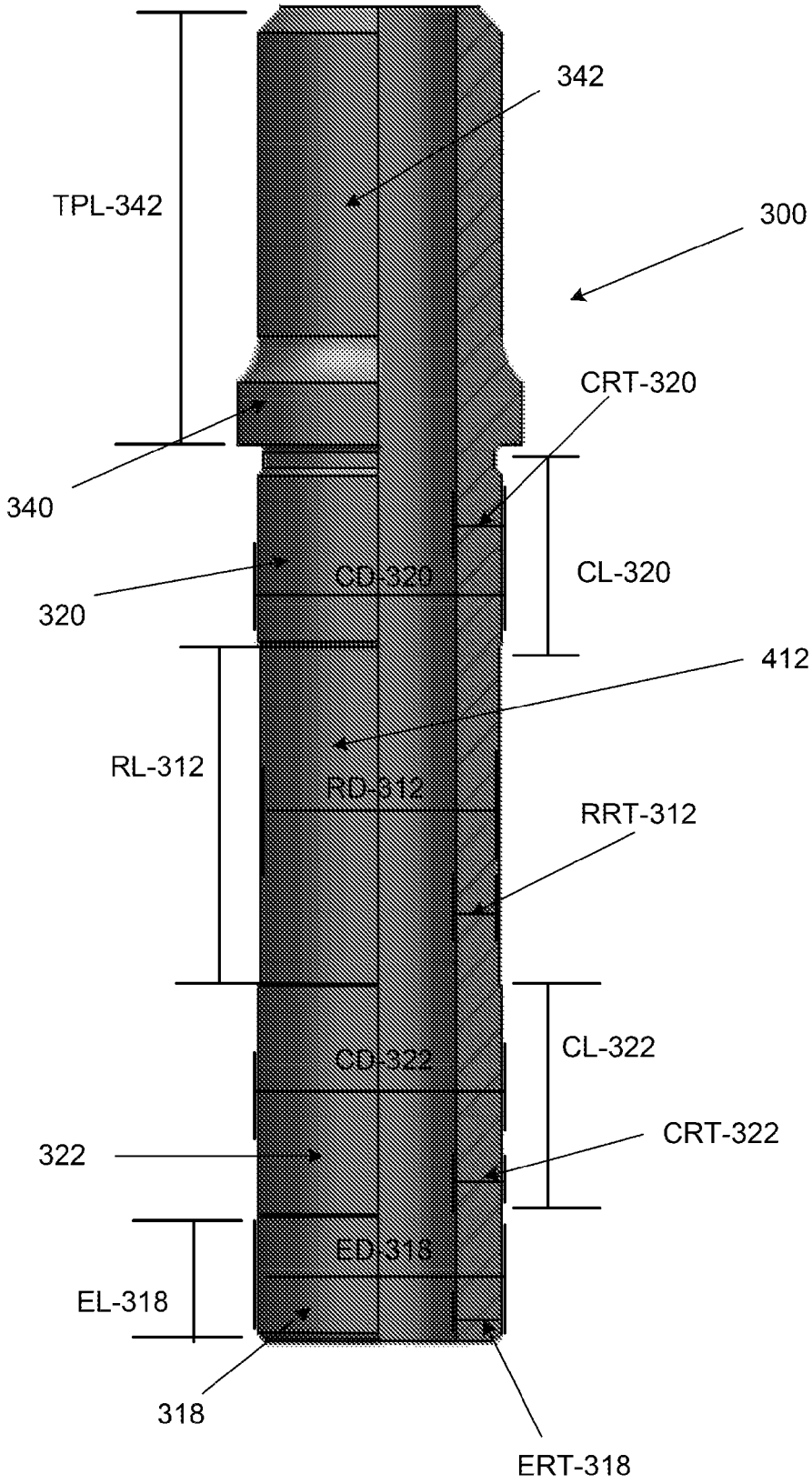
FIG. 3B is a three-quarter sectional view of the valve guide of FIG. 3A.

In another embodiment of the present invention, shown in FIGS. 3A and 3B, a valve guide 300 is provided which generally includes an extended portion 318 that reaches into the exhaust port 308 to heat the valve guide 300. The temperature in the exhaust port 308 may be between about 600° F., when the engine is at an idle position, and about 1000° F., when the engine is in full-throttle.

Additionally, a recess portion 312 is sized and shaped relative to the water jacket 310 to control the surface engagement between the valve guide 300 and the cylinder head 306. The radial thickness of the cylinder head wall 316 between the water jacket 310 and the channel 302 is also sized to maintain temperature transfer from the water jacket 310 (i.e. about 0.313 inches). The recess portion 312 spans from about 30% to about 60% of the length of the water jacket 310, so that the length of the valve guide 300 surrounded by the water jacket 310 is about 2.22 inches. The water jacket 310 is generally maintained at a temperature between about 175° F. and about 195° F. The recess portion 312 lessens the transfer of cooling temperatures from the water jacket 310 to the valve guide 300 and valve 304. As shown in FIG. 3B, the recess portion 312 in this arrangement has a diameter RD-312 of about 0.985 inches, a length RL-312 of about 1.1875 inches, and a radial thickness RRT-312 of about 0.1785 inches.

FIG. 3B illustrates a three-quarter sectional view of the valve guide 300 used in this arrangement. This valve guide 300 has a first contact portion 320 with a diameter CD-320 of about 1.0015 inches, a length CL-320 of about 0.795 inches, and a radial thickness CRT-320 of about 0.1868 inches. The valve guide 300 also has a second contact portion 322 with a diameter CD-322 of about 0.9985 inches, a length CL-322 of about 0.424 inches, and a radial thickness CRT-322 of about 0.1852 inches. The extended portion 318 of the valve guide 300 has a diameter ED-318 of about 0.9985 inches, a length EL-318 of about 1.0 inches, and a radial thickness ERT-318 of about 0.1852 inches. The valve guide 300 also has a top portion 342 with a length TPL-342 of about 1.75 inches, which includes a shoulder 340. Therefore, the total length of the valve guide 300 in this embodiment is about 5.844 inches.

The use of all of these temperature control arrangements and parameters ensure that most of the gases within the engine will not condense on the surface of the valve guide 300 and valve 304. More specifically, the arrangement provided in Example 1 allows the surface temperature to be maintained between about 227° F. and about 586° F. Although the temperature is maintained under the critical temperature of about 229° F. for a portion of the valve guide 300, the portion is near the shoulder 340 of the valve guide 300 where only minimal exhaust gases can flow. At a surface temperature of about 227° F., most condensation can still be avoided. Moreover, in this example, the extended portion 318 of the valve guide 300 is the hottest portion because it is situated within the exhaust port 308, and may be a maximum temperature of about 586° F. Additionally, the materials of the cylinder head 306 and the valve guide 300 affect the temperature of the valve 304 and valve guide 300. In the arrangement provided in Example 1, the cylinder head 306 and the valve guide 300 are composed of cast iron.

Example 2

Figure 4A:
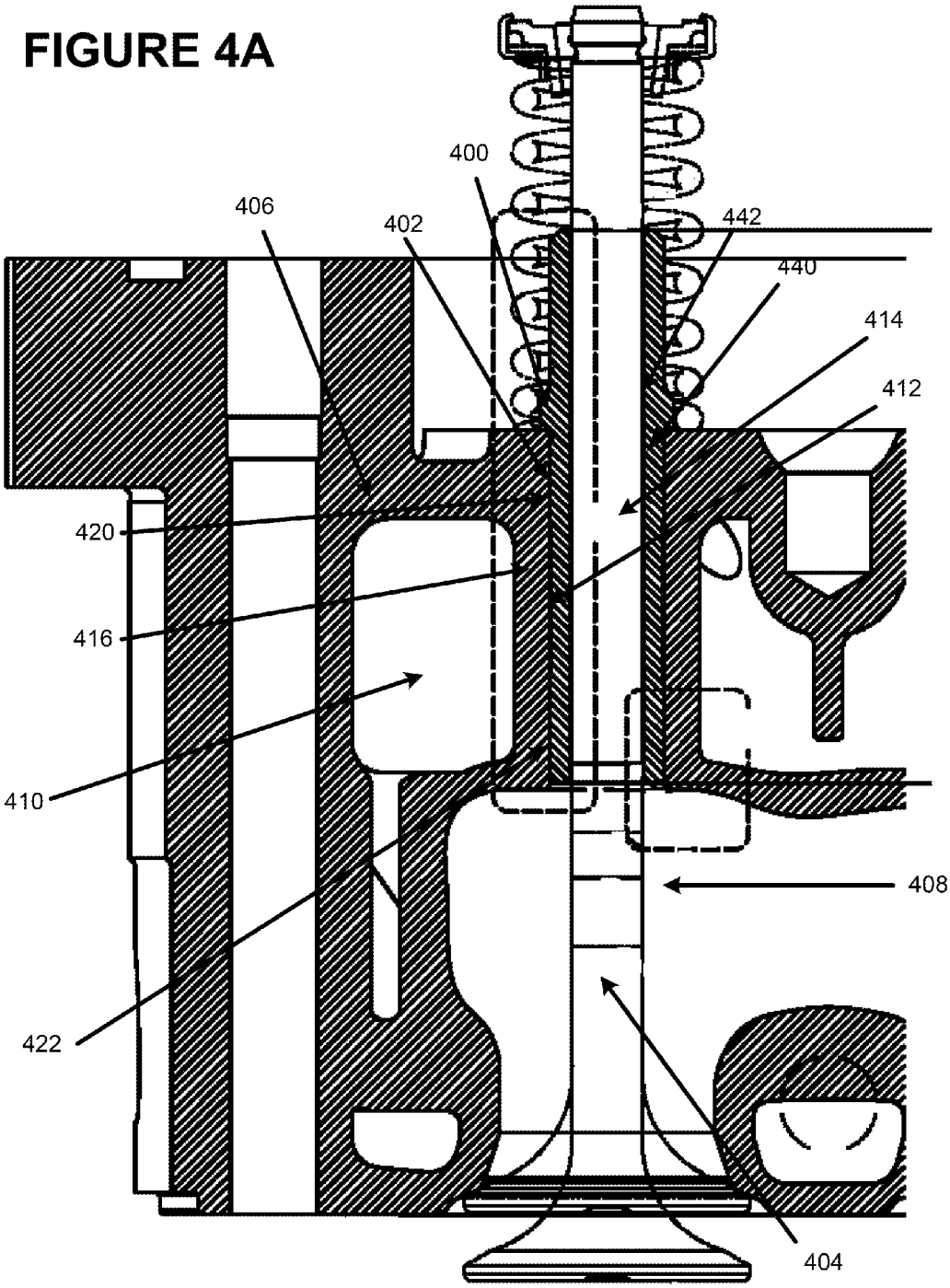
FIG. 4A is a detailed cross-sectional view of a fourth embodiment of a valve train system, which the present invention is a part, showing a valve guide including a recess portion for maintaining its surface temperature.
Figure 4B:
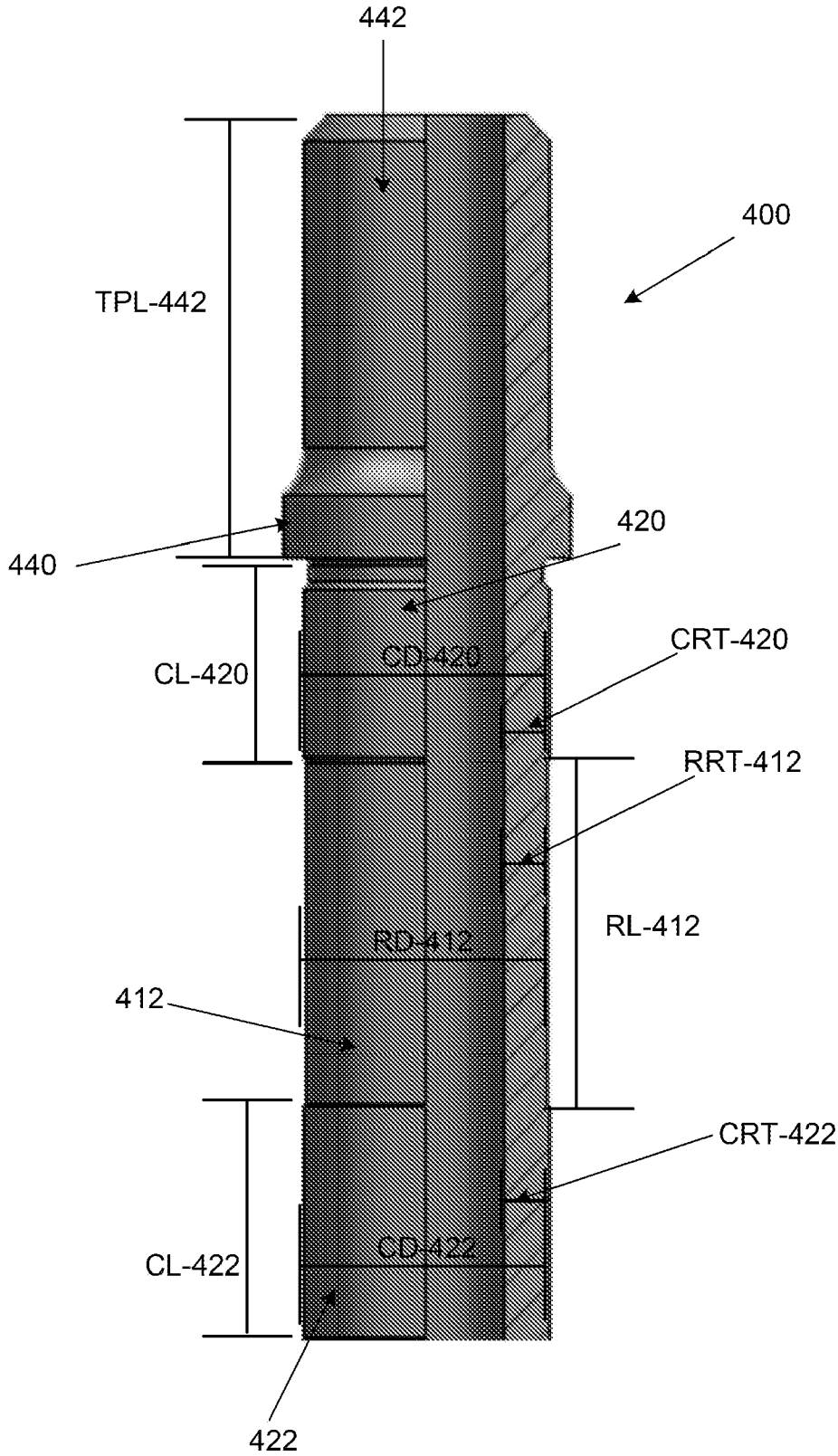
FIG. 4B is a three-quarter sectional view of the valve guide of FIG. 4A.

FIGS. 4A and 4B illustrate another embodiment of the present invention where the valve guide 400 does not extend into the exhaust port 408 and has more contact than in the embodiment illustrated in FIGS. 3A and 3B. The valve guide 400 is situated in a channel 402 formed between the valve 404 and the cylinder head 406. The valve guide 400 guides the valve stem 414 through the channel 402, which further joins the upper portion of the cylinder head 406 to an exhaust port 408.

In order to maintain the surface temperature of the valve guide 400 across the length thereof, a recess portion 412 is sized and shaped relative to the water jacket 410 to control the surface engagement between the valve guide 400 and the cylinder head 406. The radial thickness of the cylinder head wall 416 between the water jacket 410 and the channel 402, where the valve guide 400 is situated, is about 0.313 inches. The water jacket 410 is generally maintained at a temperature between about 175° F. and about 195° F.

A recess portion 412 is further provided and is sized and shaped to maintain temperature transfer from the water jacket 410 to the valve guide 400. The recess portion 412 spans from about 30% to about 60% of the length of the water jacket 410, so that the length of the valve guide 400 surrounded by the water jacket 410 is about 2.22 inches. As shown in FIG. 4B, the recess portion 412 in this embodiment has a length RL-412 of about 1.375 inches, a diameter RD-412 of about 0.985 inches, and a radial thickness RRT-412 of about 0.1785 inches.

FIG. 4B illustrates a three-quarter sectional view of the valve guide 400 described in FIG. 4A. The valve guide 400 has a first contact portion 420 with a diameter CD-420 of about 1.0015 inches, a length CL-420 of about 0.795 inches, and a radial thickness CRT-420 of about 0.1868 inches. The valve guide 400 also has a second contact portion 422 with a diameter CD-422 of about 0.9985 inches, a length CL-422 of about 0.924 inches, and a radial thickness CRT-422 of about 0.1852 inches. The valve guide 400 also has a top portion 442 having a length TPL-442 of about 1.75 inches and which includes a shoulder 440. The length of the valve guide 400 without the top portion 442 is about 3.094 inches, and the total length of the valve guide 400 in this embodiment, including the top portion 442, is about 4.844 inches.

Although about 229° F. is the ideal temperature to prevent condensation, the specific arrangement provided in Example 2 may cause the surface temperature along the valve guide 400 to between about 227° F. and about 568° F. When the valve guide 400 has a surface temperature of about 227° F., most condensation of $H_2SO_4$ is still avoided between the valve guide 400 and the valve 404. Moreover, in this example, the bottom portion of the valve guide 400 is the hottest portion because it is situated next to the exhaust port 408, and may be a maximum temperature of about 568° F. Accordingly, the portion near the shoulder 440 (farther away from the exhaust port 408) has a temperature of about 227° F. However, because minimal exhaust gases flow to this portion, damage to it is minimized. Additionally, the materials of the cylinder head 406 and the valve guide 400 affect the temperature of the valve 404 and valve guide 400. In the arrangement provided in Example 2, the cylinder head 406 and the valve guide 400 are composed of cast iron.

Example 3

Figure 5A:
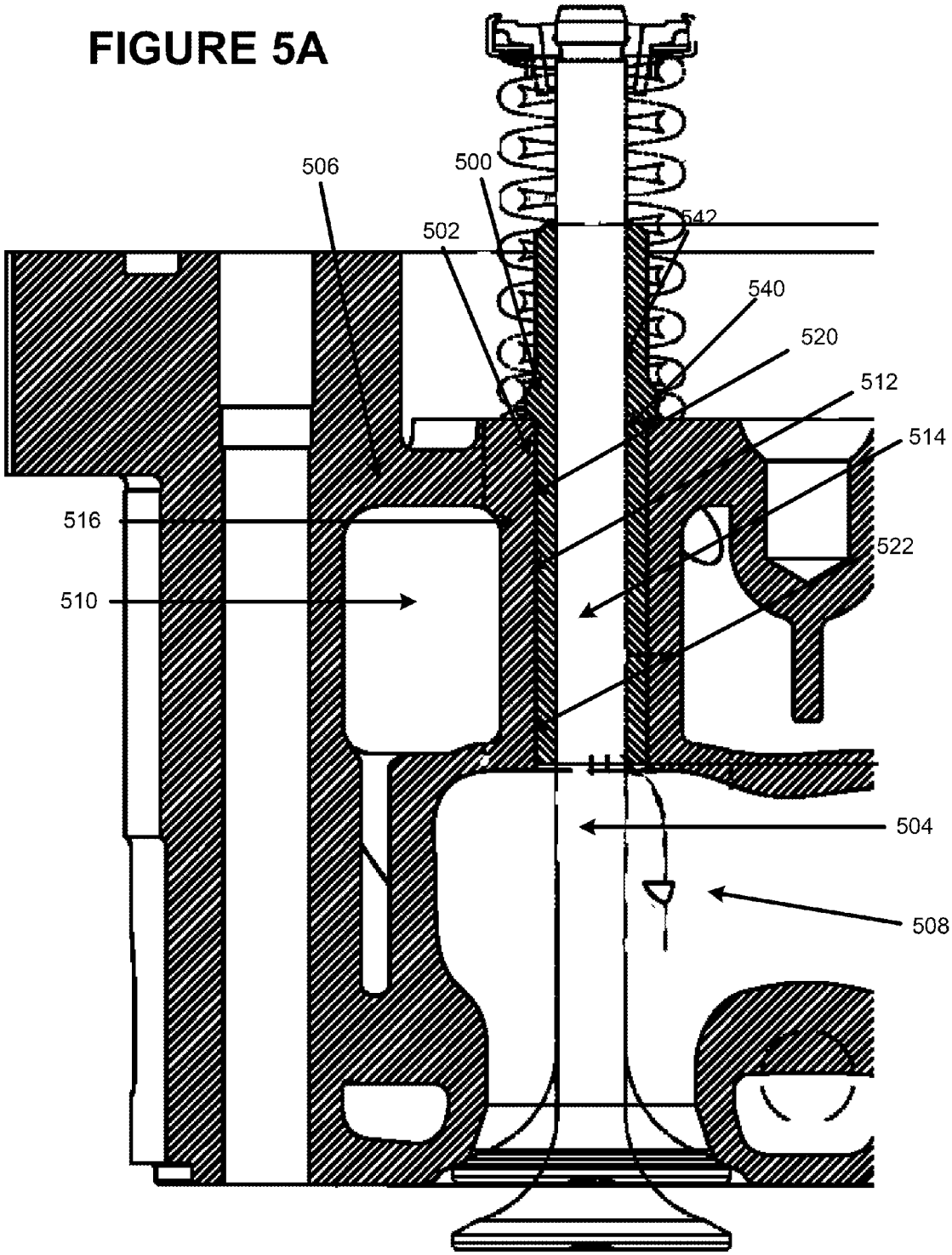
FIG. 5A is a detailed cross-sectional view of a fifth embodiment of a valve train system, which the present invention is a part, showing a valve guide including a recess portion for maintaining its surface temperature.
Figure 5B:
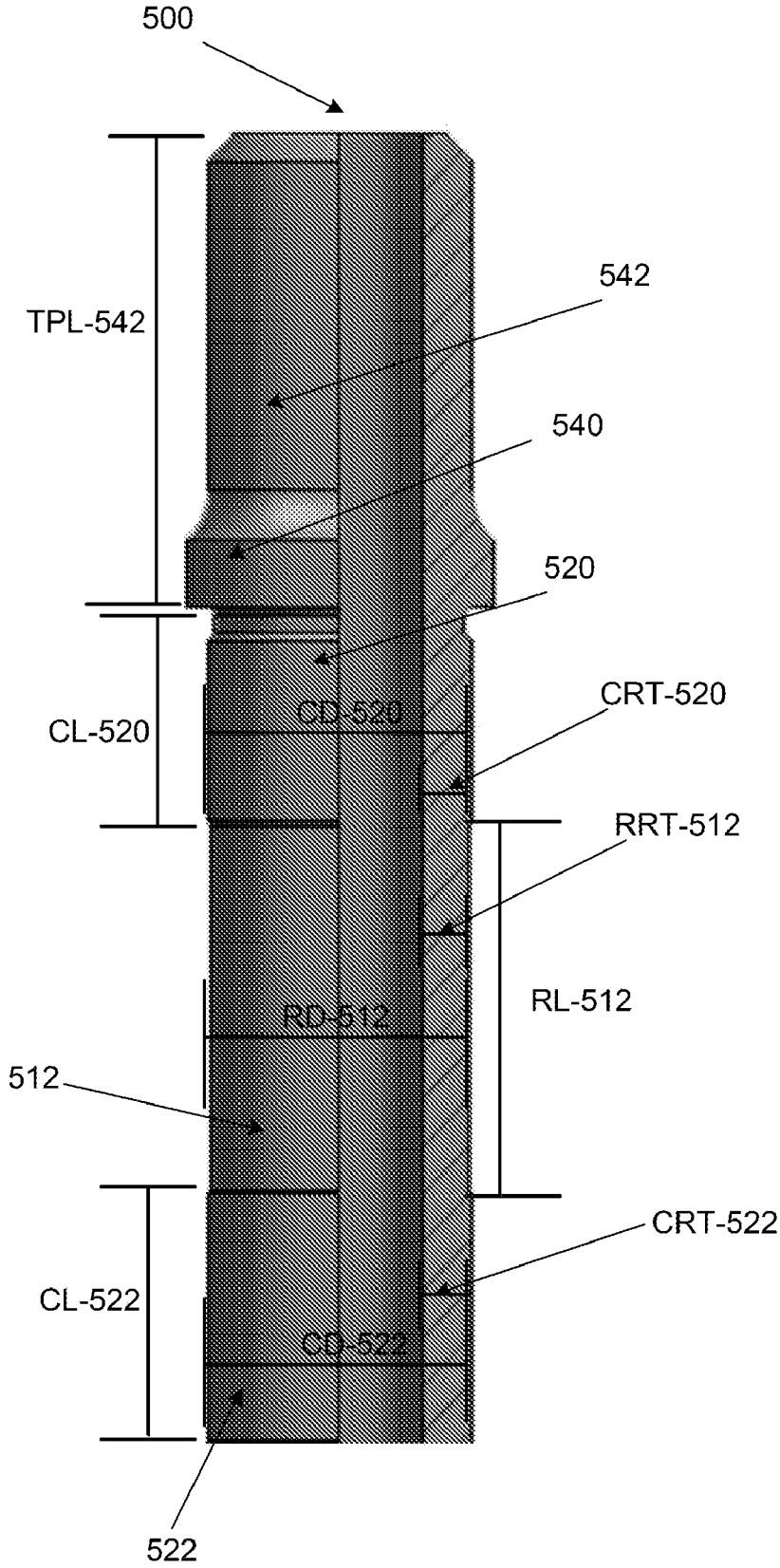
FIG. 5B is a three-quarter sectional view of the valve guide of FIG. 5A.

In yet another embodiment of the present invention, as shown in FIGS. 5A and 5B, a valve guide 500 has the most contact with the cylinder head wall 516 compared to the other embodiments of the present invention. The valve guide 500 is situated in a channel 502 formed between a valve 504 and a cylinder head wall 516. The cylinder head wall 516 generally has a radial thickness of about 0.313 inches between the water jacket 510 and the channel 502. The valve guide 500 guides the valve stem 514 through the channel 502, which further joins the upper portion of the cylinder head 506 to an exhaust port 508. The cylinder head 506 includes a water jacket 510, which is disposed near the channel 502. The water jacket 510 is generally maintained at a temperature between about 175° F. and about 195° F. The surface temperature of the valve guide 500 is generally maintained above the critical temperature of 229° F. to avoid condensation, and thereby acidic corrosion. Although temperatures may vary from the bottom portion of the valve guide 500 to its top portion 542, the entire length is maintained above about 229° F. In order to maintain the critical surface temperature throughout the valve guide 500, this embodiment generally includes a recess portion 512 and contact portions 520, 522.

The recess portion 512 is sized and shaped relative to the water jacket 510 to control the surface engagement between the valve guide 500 and the cylinder head 506. The recess portion 512 spans from about 30% to about 60% of the length of the water jacket 510, so that the length of the valve guide 500 surrounded by the water jacket 510 is about 2.22 inches. Therefore, the recess portion 512 is sized and shaped to control temperature transfer from the water jacket 510 to the valve guide 500. As shown in FIG. 5B, the recess portion 512 in this embodiment has a length RL-512 of about 0.875 inches, a diameter RD-512 of about 0.985 inches, and a radial thickness RRT-512 of about 0.1785 inches.

FIG. 5B is a three-quarter sectional view of the valve guide 500 described in FIG. 5A. The valve guide 500 has two contact portions 520, 522. The first contact portion 520 has a length CL-520 of about 0.795 inches, a diameter CD-520 of about 1.0015 inches, and a radial thickness CRT-520 of about 0.1868 inches. The second contact portion 522 has a length CL-522 of about 1.424 inches, a diameter CD-522 of about 0.9985 inches, and a radial thickness CRT-522 of about 0.1852 inches. The valve guide 500 also has a top portion 542 with a length TPL-542 of about 1.75 inches, which includes a shoulder 540. The length of the valve guide 500 without the top portion 542 is about 3.094 inches. The total length of the valve guide 500 in this embodiment, including the top portion 542, is about 4.844 inches.

The specific arrangement provided in Example 3 allows the surface temperature to be maintained between about 232° F. and about 560° F. The surface temperature across the entire length of the valve guide 500 is maintained above about 229° F., when the engine is in full-throttle, in order to prevent condensation of $H_2SO_4$. Moreover, in this example, the bottom portion of the valve guide 500 is the hottest portion because it is situated next to the exhaust port 508, and may be a maximum temperature of about 560° F. Additionally, the materials of the cylinder head 506 and the valve guide 500 affect the temperature of the valve 504 and valve guide 500. In the arrangement provided in Example 3, the cylinder head 506 and the valve guide 500 are composed of cast iron.

Example 4

Figure 6A:
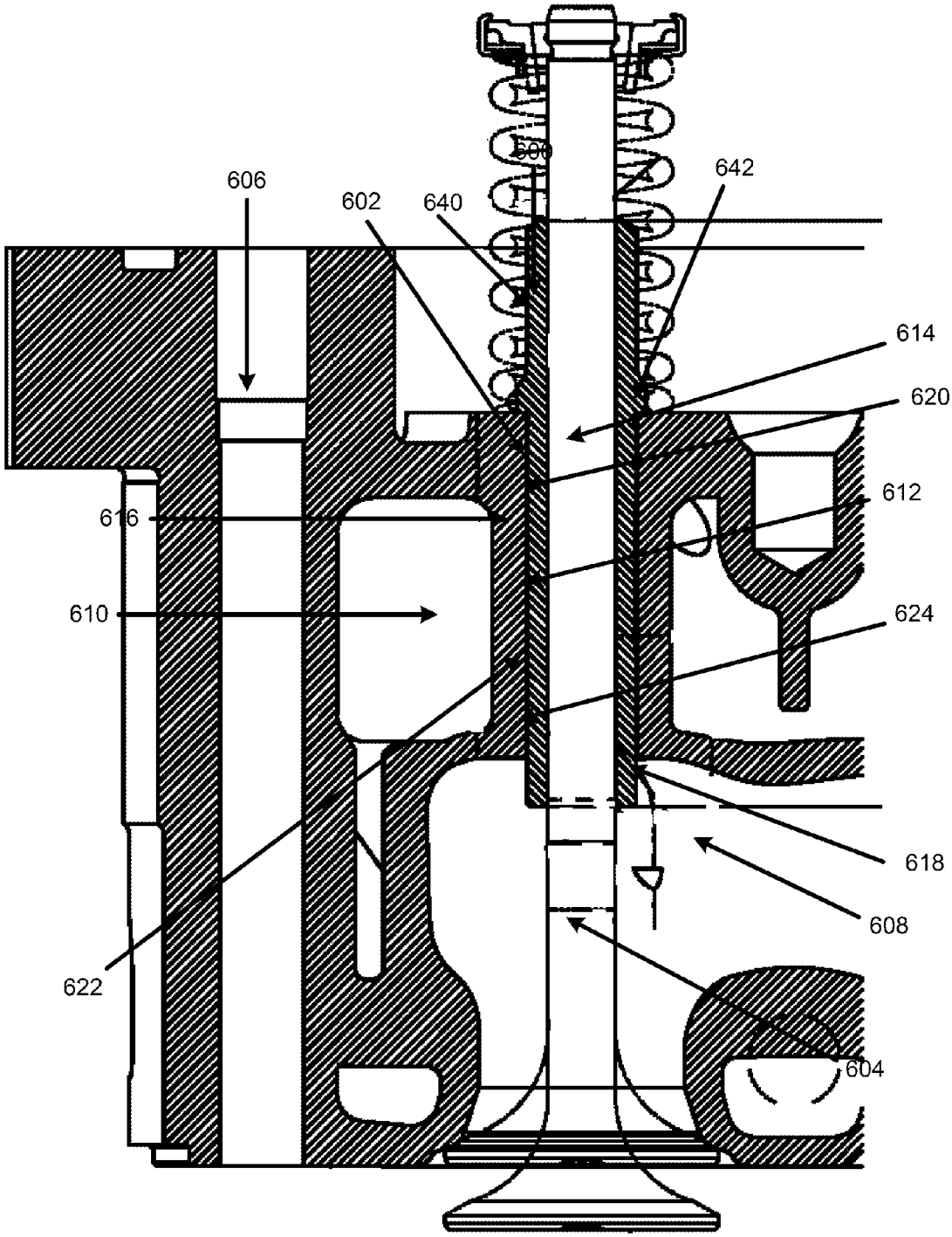
FIG. 6A is a detailed cross-sectional view of a sixth embodiment of a valve train system, which the present invention is a part, showing a valve guide including a recess portion for maintaining its surface temperature.
Figure 6B:
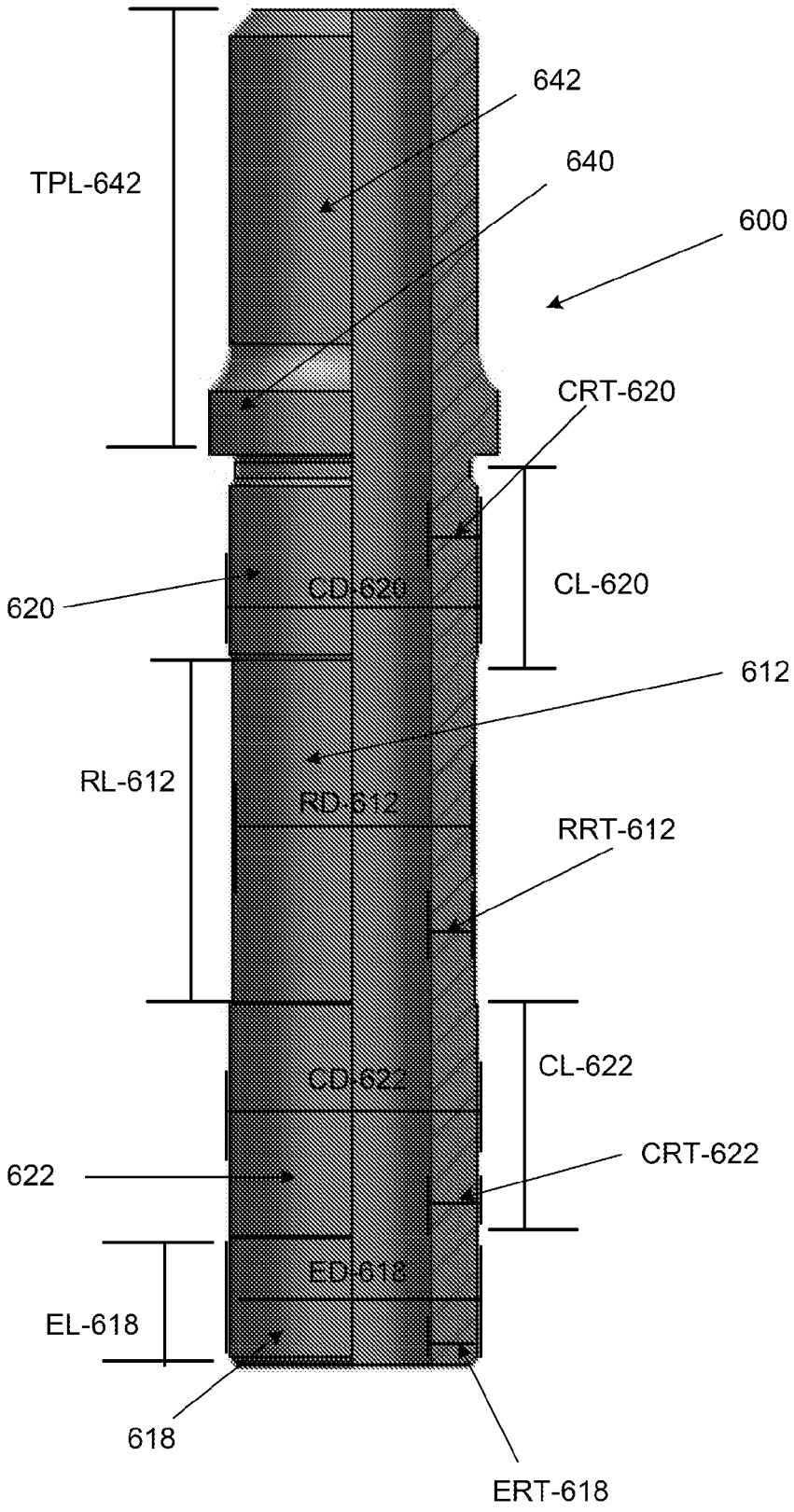
FIG. 6B is a three-quarter sectional view of the valve guide of FIG. 6A.

FIGS. 6A and 6B illustrate yet another embodiment of the present invention where an extended valve guide 600 has two contact portions 620, 622 and a recess portion 612. The valve guide 600 is situated in a channel 602 formed between the valve 604 and the cylinder head 606. The valve guide 600 guides the valve stem 614 through the channel 602, which further joins the upper portion of the cylinder head 606 to an exhaust port 608. The cylinder head 606 includes a water jacket 610, which is disposed near the channel 602.

In this embodiment, the valve guide 600 includes an extended portion 618 which extends into the exhaust port 608, for heating thereof. The temperature in the exhaust port 608 may be between about 600° F., when the engine is at an idle position, and about 1000° F., when the engine is in full-throttle. The hottest portion of the valve guide 600—the extended portion 618—is heated by the exhaust port 608 and then heats the entire valve guide 600, thereby maintaining the surface temperature of the valve guide 600.

The water jacket 610 is generally maintained at a temperature between about 175° F. and about 195° F. The recess portion 612 is sized and shaped to control the temperature transfer from the water jacket 610 to the valve guide 600. As shown in FIG. 6B, the recess portion 612 in this arrangement has a diameter RD-612 of about 0.985 inches, a length RL-612 of about 1.1875 inches, and a radial thickness RRT-612 of about 0.1785 inches.

FIG. 6B shows a three-quarter sectional view of the valve guide 600 described in FIG. 6A. The valve guide 600 in this embodiment has two contact portions 620, 622 and an extension 618. The first contact portion 620 has a length CL-620 of about 0.795 inches, a diameter CD-620 of about 1.0015 inches, and a radial thickness CRT-620 of about 0.1868 inches. The second contact portion 622 has a length CL-622 of about 0.924 inches, a diameter CD-622 of about 1.0015 inches, and a radial thickness CRT-622 of about 0.1868 inches. The extended portion 618 has a length EL-618 of about 0.5 inches, a diameter ED-618 of about 0.9985 inches, and a radial thickness ERT-618 of about 0.1852 inches. The valve guide 600 also has a top portion 642 with a length TPL-642 of about 1.75 inches, which includes a shoulder 640. The total length of the valve guide 600 in this embodiment, including the top portion 642, is about 5.344 inches.

The specific arrangement provided in Example 4 allows the surface temperature to be maintained between about 221° F. and about 497° F. Moreover, in this example, the bottom portion of the valve guide 600 is the hottest portion because it is situated next to the exhaust port 608, and may be a maximum temperature of about 497° F. Although the temperature is maintained under the critical temperature of about 229° F. for a portion of the valve guide 600, this portion is near the shoulder 640 of the valve guide 600 where only minimal exhaust gases can flow. Moreover, at a surface temperature of about 227° F., most condensation can still be avoided. Additionally, the materials of the cylinder head 606 and the valve guide 600 affect the temperature of the valve 604 and valve guide 600. In the arrangement provided in Example 4, the cylinder head 606 and the valve guide 600 are composed of cast iron.

Tables 2, 3 and 4 provide a summary of the various embodiments of the present invention, as described in the examples above. The embodiments' respective dimensions are shown in Table 2 below. Each embodiment also includes a top portion with a length of about 1.75 inches, which includes a shoulder. This length is included in the calculation of the total length of each valve guide shown in Table 2. Table 3 shows the range of temperatures that each embodiment of the present invention valve guide may attain. Table 4 shows the radial thickness of each part of the valve guide in each respective embodiment. Radial thickness is different than diameter. The diameter of the valve guide is calculated by measuring from the outside of the valve guide. By contrast, the radial thickness of the valve guide is measured from the outer portion to the inside, thereby measuring the thickness of the valve guide wall. In Tables 2-4, the valve guide embodiments were tested in similar conditions. For example, the valve guide and cylinder head in each embodiment are made from a cast iron material. Moreover, the water jacket in each embodiment has a temperature maintained between about 175° F. and about 195° F.

TABLE 2

| | CONTACT PORTION 1 | | RECESS PORTION | | CONTACT PORTION 2 | | EXTENDED PORTION | | TOTAL LENGTH |
|---|---|---|---|---|---|---|---|---|---|
| EXAMPLE | Len (in) | Dia (in) | Len (in) | Dia (in) | Len (in) | Dia (in) | Len (in) | Dia (in) | Len (in) |
| 1 | 0.795 | 1.0015 | 1.875 | 0.985 | 0.424 | 0.9985 | 1.0 | 0.9985 | 5.844 |
| 2 | 0.795 | 1.0015 | 1.375 | 0.985 | 0.924 | 0.9985 | N/A | N/A | 4.844 |
| 3 | 0.795 | 1.0015 | 0.875 | 0.985 | 1.424 | 0.9985 | N/A | N/A | 4.844 |
| 4 | 0.795 | 1.0015 | 1.375 | 0.985 | 0.924 | 1.0015 | 0.5 | 0.9985 | 5.344 |

TABLE 3

| | TEMPERATURE | | |
|---|---|---|---|
| EXAMPLE | Max (° F.) | Min (° F.) | DESCRIPTION |
| 1 | 586 | 227 | With extension |
| 2 | 568 | 227 | No extension, more contact |
| 3 | 560 | 232 | No extension, most contact |
| 4 | 497 | 221 | Two contacts, central recess and pilot relief |

TABLE 4

| EXAMPLE | CONTACT PORTION 1 Width (in) | RECESS PORTION Width (in) | CONTACT PORTION 2 Width (in) | EXTENDED PORTION Width (in) |
|---|---|---|---|---|
| 1 | 0.1868 | 0.1785 | 0.1852 | 0.1852 |
| 2 | 0.1868 | 0.1785 | 0.1852 | N/A |
| 3 | 0.1868 | 0.1785 | 0.1852 | N/A |
| 4 | 0.1868 | 0.1785 | 0.1868 | 0.1852 |

Embodiments of the present invention relate to a valve guide for a valve train system, and more specifically, to a valve guide for preventing acidic corrosion between the valve guide and a valve. In another aspect of the present invention, the valve guide provides a method of controlling the surface temperature of a valve to further prevent corrosion. The above description is presented to enable one of ordinary skill in the art to make and use the invention and is provided in the context of a patent application and its requirements.

Modifications to the various embodiments and the generic principles and features described herein will be readily apparent to those skilled in the art. For example, although the various embodiments show the valve guide and the cylinder head comprising a material of cast iron, other materials may be used. Altering the composition of these materials may also alter temperature transfer.

Moreover, although the cylinder head wall in the various embodiments has a radial thickness of about 0.313 inches, it may be thinner or thicker. The thickness of the cylinder head wall will affect the temperature between the valve and the valve guide. Similarly, the radial thickness of the valve guide will affect the maintenance of surface temperature. The various embodiments have specific thicknesses; however, other thicknesses may be used. Additionally, if a surface treatment is used on the valve guide or cylinder head, the temperatures and various dimensions may be affected. Temperatures in the water jacket and exhaust port may further be adapted to maintain the surface temperature of the valve guide. Thus, the present invention is not intended to be limited to the embodiments shown, but is to be accorded the widest scope consistent with the principles and features described herein.

What is claimed:

1. A valve guide for guiding a stem of a valve through a channel formed in a cylinder head which joins the upper portion of the cylinder head to an exhaust port, said cylinder head including a water jacket disposed near said channel, said valve guide comprising:

a first portion which engages the channel near the upper portion of the cylinder head, a second portion which engages the channel near the exhaust port, and a recess portion situated in relation to the water jacket and between said first and second portions, said recess portion and first and second engagement portions being sized and shaped to maintain the surface temperature of the valve guide to prevent condensation of acidic gases between the valve stem and the valve guide, wherein the first and second engagement portions each have a select diameter which defines a tighter or looser engagement with the channel, and the diameter of the first engagement portion is larger than the diameter of the second engagement portion such that the engagement between the first engagement portion and the channel is tighter than the engagement between the second engagement portion and the channel.

2. The valve guide of claim 1 wherein the surface temperature of the valve guide is adapted to be maintained above about 200° F.

3. The valve guide of claim 2 wherein the surface temperature of the valve guide is adapted to be maintained above about 229° F.

4. The valve guide of claim 1 wherein the first engagement portion spans a greater length than the second engagement portion.

5. The valve guide of claim 1 wherein the second engagement portion spans a greater length than the first engagement portion.

6. The valve guide of claim 1 further comprising an extension portion joined near the second engagement portion which extends into the exhaust port.

7. The valve guide of claim 1 wherein the extension portion is sized and shaped to facilitate the maintaining of the surface temperature of the valve guide.

8. The valve guide of claim 1 further comprising a shoulder situated near the first engagement portion for positioning the valve guide within the channel.

9. The valve guide of claim 1 wherein the first engagement portion spans a length of about 0.795 inches and has a diameter of about 1.0015 inches, the recess portion spans a length selected between about 0.875 inches and about 1.875 inches and has a diameter of about 0.985 inches, and the second engagement portion spans a length selected between about 0.424 inches and about 1.424 inches.

10. The valve guide of claim 9 wherein the first engagement portion spans a length of about 0.795 inches and has a diameter of about 1.0015 inches, the recess portion spans a length of about 0.875 inches and has a diameter of about 0.985 inches, and the second engagement portion spans a length of about 1.424 inches and has a diameter of about 0.9985 inches.

11. The valve guide of claim 9 further comprising an extension portion spanning a length between about 0.5 and about 1 inches and having a diameter of about 0.9985 inches.

* * * * *